US010107274B2

(12) United States Patent
Noui-Mehidi et al.

(10) Patent No.: US 10,107,274 B2
(45) Date of Patent: Oct. 23, 2018

(54) ELECTRICAL SUBMERSIBLE PUMP ASSEMBLY FOR SEPARATING GAS AND OIL

(71) Applicant: Saudi Arabian Oil Company, Dhahran (SA)

(72) Inventors: Mohamed Nabil Noui-Mehidi, Dhahran (SA); Rabea Ahyad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 422 days.

(21) Appl. No.: 13/852,699

(22) Filed: Mar. 28, 2013

(65) Prior Publication Data

US 2013/0259721 A1 Oct. 3, 2013

Related U.S. Application Data

(60) Provisional application No. 61/619,062, filed on Apr. 2, 2012.

(51) Int. Cl.
*F04B 17/03* (2006.01)
*F04B 47/06* (2006.01)
(Continued)

(52) U.S. Cl.
CPC ..... *F04B 17/03* (2013.01); *E21B 43/128* (2013.01); *E21B 43/38* (2013.01); *F04B 47/06* (2013.01)

(58) Field of Classification Search
CPC ..... F04B 47/06; F04B 17/03; E21B 43/128; E21B 43/38
(Continued)

(56) References Cited

U.S. PATENT DOCUMENTS 3,128,719 A 4/1964 Jongbloed et al.
4,531,584 A 7/1985 Ward
(Continued)

FOREIGN PATENT DOCUMENTS

CN 2881091 3/2007
GB 2409691 A 7/2005

*Primary Examiner* — Essama Omgba
*Assistant Examiner* — Stephen Mick
(74) *Attorney, Agent, or Firm* — Abelman, Frayne & Schwab

(57) ABSTRACT

An electrical submersible pump assembly for use in a well, including a well having a high gas-to-liquid ratio has a motor, a hollow, tubular drive shaft which drives the pump, and a liquid-gas separator assembly upstream of the pump intake. The liquid-gas separator has a hollow tubular portion, which communicates with the open, lower end of the drive shaft, openings through its sidewall, and a closed lower end. The sidewall also includes at least one outwardly extending projection shaped for urging liquid contained in a liquid/gas mixture flowing towards the pump outwardly, away from the sidewall openings. Preferably, the outwardly extending projection comprises a helical blade which, using either the well casing or a separate sheath, defines a helical channel through which the oil-gas mixture flows prior to reaching the pump intake. The centrifugal force in the channel forces the oil component away from the openings and forces the gas component through the openings, where such gas may be vented to the surface.

13 Claims, 3 Drawing Sheets

(51) Int. Cl.
*E21B 43/38* (2006.01)
*E21B 43/12* (2006.01)

(58) Field of Classification Search
USPC ..... 417/423.3, 313
See application file for complete search history.

(56) References Cited

U.S. PATENT DOCUMENTS

| | | | | |
|---|---|---|---|---|
| 4,900,433 | A * | 2/1990 | Dean et al. | 210/170.11 |
| 5,482,117 | A * | 1/1996 | Kolpak et al. | 166/265 |
| 6,113,675 | A | 9/2000 | Branstetter | |
| 6,120,261 | A * | 9/2000 | Al-Towailib | F04D 13/10 417/356 |
| 2005/0217859 | A1 * | 10/2005 | Hartman et al. | 166/369 |

* cited by examiner

ELECTRICAL SUBMERSIBLE PUMP ASSEMBLY FOR SEPARATING GAS AND OIL

BACKGROUND OF THE INVENTION

The present invention relates to electrical submersible pumps for use in pumping oil from the borehole of a well to the surface.

An example of a known electrical submersible pump assembly is disclosed in commonly owned U.S. Pat. No. 6,120,261. The assembly includes an electric motor section and a pump section. A hollow drive shaft has one end fixed to the rotor of the motor. The other end of the drive shaft extends into the pump portion of the assembly, to rotate pump impellers contained in a pump housing. Oil from the reservoir enters the hollow drive shaft, and is drawn into the lower end of the pump housing through a series of holes formed in the shaft. The impellers pump the oil upwardly to the upper end of the pump housing, where the oil is forced through another series of holes back into the hollow shaft. The upper end of the drive shaft is connected to piping for thereafter delivering the oil to the surface.

While submersible pumps of the type described in the '261 patent are widely used in the oil industry, such pumps may not be suitable for use in wells having a high gas-to-oil ratio, i.e., wells having a gas/oil ratio exceeding approximately 60% free gas. Even at 60%, pumping can be effected only by installing additional special pump stages to the pump where the fluids are mixed and prepared for the main pump stages. However, in some high gas-to-oil ratio wells, irregular flows of 100% gas may occur, and even the just-described measures may be ineffective.

Currently, high gas-to-oil wells with wellhead pressure can flow freely to the processing facility without boosting. When the pressure is not sufficient, the wells will cease to flow and production losses occur across the field.

Surface horizontal multi-phase pumps is a known solution but can have drawbacks. Such systems require upgrading surface facilities (pipe lines, new site, electric power, etc.) to install the large, rotating equipment needed.

SUMMARY OF THE INVENTION

An electrical submersible pump assembly for use in a well comprises a pump, an electric motor for driving the pump, and a liquid-gas separator assembly located upstream of the pump intake. A hollow drive shaft, which is driven by the motor and drives the pump, extends through the motor and pump housings to provide a hollow passage which extends through both housings.

The liquid-gas separator assembly has a hollow tubular portion having one end communicating with the open, lower end of the drive shaft. The tubular portion includes a sidewall portion having openings and a closed, lower end. At least one outwardly extending projection extends from the sidewall. Such projection or projections are shaped for urging liquid contained in a liquid/gas mixture which is flowing towards the pump to flow away from the openings and, at the same time, cause gas contained in the liquid/gas mixture to flow through the openings into the hollow interior of the tubular portion. In such a manner, such gas may thereafter flow outwardly from the tubular portion through the drive shaft interior and vented to the surface.

Preferably, the at least one outwardly extending projection comprises a helical blade which extends spirally about said separator tubular portion to cause liquid drawn towards said pump to travel in a helical path. Also, preferably, the helical blade is secured to the separator tubular portion, and said tubular portion is coupled to the drive shaft such that the drive shaft rotates without rotating the helical blade and tubular portion rotate with the drive shaft.

The outer edge of the helical blade is preferably either tightly fit within the well casing or surrounded by a sheath. In either configuration, a helical channel is formed through which the oil/gas mixture must flow before reaching the pump intake. Due to the centrifugal force present while the mixture flows through the channel, oil will be kept away from the openings in the sidewall, while gas will be pressed to flow through such channels.

In such a manner, gas in the oil/gas mixture is removed, at least in part, as the mixture flows upwardly towards the pump, and the mixture which reaches the pump intake is mainly oil, with a gas-to-oil ratio low enough for the pump to handle. Further, because the helical channel can be any length, substantially all of the gas may be removed from the mixture if desired. The present invention may thus be used in oil wells including oil wells having a high gas-to-oil ratios.

In a preferred embodiment, stationary (i.e., non-rotating) tubing is connected to the upper end of the drive shaft and extends to the surface of the well, so that gas and liquid exit from the well separately.

In the present invention, separation of gas and liquid is done downhole as part of an electrical submersible pump. This will eliminate the need for the large rotating equipment and upgrades needed to perform surface multi-phase pumping. It also will improve pump efficiency, since the pump is boosting mainly liquid rather than gas, and prevent gas slugs into the pump. The invention provides tailored boosting for each well to overcome the back pressure at the surface and reach out to the production facility.

DETAILED DESCRIPTION OF PREFERRED EMBODIMENTS

Figure 1:
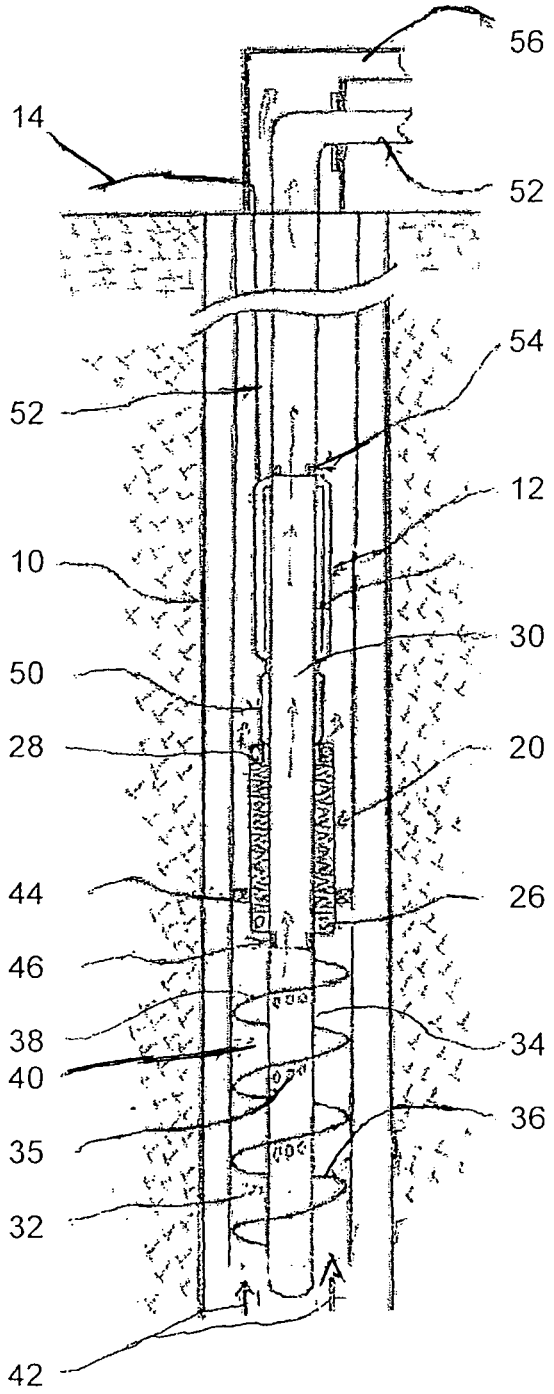
FIG. 1 is a side, sectional view of a well borehole having a pump assembly according to the invention along with associated tubing.
Figure 2:
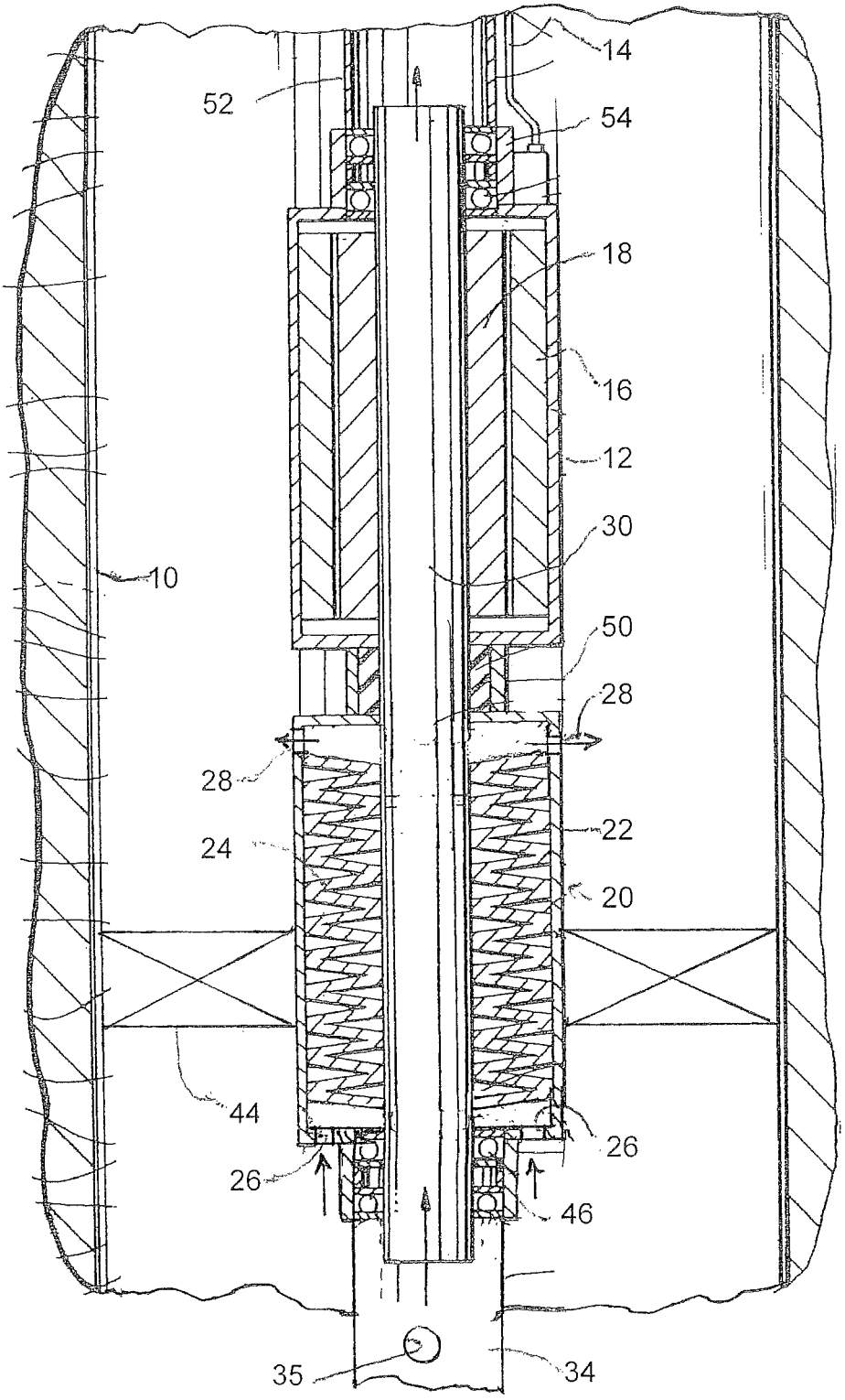
FIG. 2 is an enlarged, side view of the hollow shaft pump assembly.

FIG. 1 depicts schematically a well having a well casing 10 containing a gas/oil mixture with a high gas-to-oil ratio. An electrical submersible pump assembly, portions of which are shown in more detail in FIG. 2, comprises an electrical motor 12 which receives power through an electrical cable 14. The electrical motor includes a stator 16 and a rotor 18.

A pump 20, which may be of the type described in U.S. Pat. No. 6,120,261, which is incorporated by reference herein, includes a pump housing 22 and internal pump stages 24. The pump housing 22 has intake openings 26 at its lower end, and outlet openings 28 at its upper end. The intake openings 26 may be located on an end wall of the pump housing 22, or on the sidewall portions of the pump housing 22, as desired. The pump discharge points (outlet openings 28) are located at the end of the pump stages 24 (and may be located in the sidewall or upper end of the pump housing).

A hollow, tubular drive shaft 30 has an upper portion secured to the rotor 18 so as to be driven by the rotor, and a lower portion which is secured to the pump stages 24 to drive the pump 20. The drive shaft 30 is open at its upper and lower ends, and extends through both the motor and pump housings.

As shown in FIG. 1, a liquid-gas separator assembly 32 includes a hollow tubular portion 34 which extends downwardly from the lower end of the drive shaft 30. The upper end of the tubular portion 34 communicates with the hollow interior of the drive shaft 30. The tubular portion 34 preferably is secured to the drive shaft 30 by a seal bearings 46 which allows the tubular portion 34 to remain stationary as the drive shaft 30 rotates. A plurality of ports or vents 35 are formed through the sidewall of the tubular portion 34 to allow gas in the well to flow into the hollow interior of the tubular portion 34.

The assembly 32 also includes a projecting member which extends outwardly from the tubular portion 34 for separating gas and oil. In the embodiment shown in FIG. 1, the projecting member is in the form of a helical blade 36 which extends spirally around the tubular portion 34. The outer edge 38 of the blade 36 is tightly fixed to the well casing 10, whereas the inner edge of the helical blade 36 is tightly fixed to the tubular portion 34, thereby forming a helical channel 40 below the pump 20. Thus, the oil/gas mixture, which is being drawn upwardly by the pump in the direction of arrows 42, must flow through the helical channel 40 before reaching the pump 20.

The pump outside housing 22 is fixed in the well bore relative to the well casing 10. A packer 44 is positioned around the pump housing 22 between the pump housing 22 and well casing 10 in order to isolate the pump intake openings 26 from the pump outlet openings 28. In this manner, fluids can neither bypass the pump nor flow from the pump outlets back into the well. The separator hollow tube 34 is connected to the drive shaft 30 via the seal bearing 46 which allows rotation of the drive, shaft 30 while allowing the tubular portion 34 to remain fixed.

The pump and motor are connected by a seal 50 through which the drive shaft 30 extends. At the upper end of the motor 12, outlet tubing 52 is connected to the upper end of the drive shaft 30 via a seal bearing 54 which allows the drive shaft 30 to rotate while the outlet gas tubing 52 is fixed via a hanger at the wellhead.

In operation, the gas/oil mixture is drawn upwardly, in the direction of arrows 42, toward the pump 20. Upon encountering the liquid/gas separator assembly, the mixture is forced to follow the helical path of the channel 40 towards the pump 20. The centrifugal outward force on the mixture causes the heavier element, oil, towards the outside of the helical channel 40, i.e., towards the well casing 10, which in turn forces the lighter component, gas, inwardly toward the tubular portion 34. Due to pressurization, the gas glows from the helical channel 40 through the vents 35 into the interior of the tubular portion 34. Once inside the tubular portion 34, gas is free to flow upwardly, through the drive shaft 30, through the outlet tubing 52, and thereafter out of the well.

As the oil component of the mixture flows towards the pump intake openings 26, the centrifugal force created while flowing through the helical channel 40 keeps the oil component separated from the vents 35. Once clear of the helical channel 40, oil is drawn into the pump 20 through the intake openings 26 and discharged at the upper end of the pump housing 22 through the outlet openings 28. The oil then flows upwardly and out of the well in the annulus between the motor housing 12 and the well casing 10/outlet tubing 52. At the well head, the two fluid streams of oil and gas can be delivered through outlet tubing 52 or recombined in the main production trunk line, e.g., with a jet pump. In cases where the well production is only intermittently a gas/oil mixture, the end of the gas/liquid separator assembly can be equipped with a relief valve that opens when excess liquid enters the separator hollow tubular portion 34 through the vents 35.

When the system is installed in the well, the setting point should be as deep into the well as possible to ensure the depth of the fluid's bubble point is avoided to keep the gas volumes to a minimum and therefore assure a complete separation of the gas component from the production fluids. The system is meant to separate the free flowing gas associated from production, not separated by the pressure drop in the wellhead, in situations where high gas-to-oil ratios are experienced or some gas breakthrough occurs at the pump depth.

Figure 3:
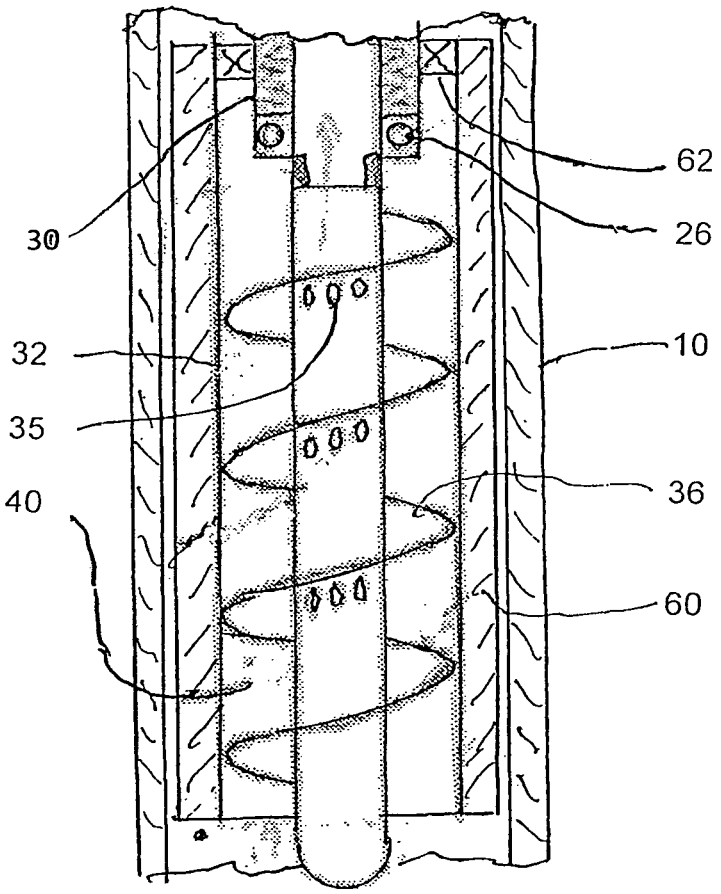
FIG. 3 shows the gas-liquid segregation stage before entering the lower pump intake point.

In an alternative embodiment shown in FIG. 3, instead of tightly fitting the outer edge of the helical blade 36 against the well casing 10, the blade 36 is surrounded by a sheath 60 which, in turn, fits within the casing 10. The sheath 60 and blade 36 combine to form the helical channel 40 through which the oil/gas mixture must travel before reaching the pump intake openings 26. Also, the upper end of the sheath 60 may include a packer 62 between the sheath 60 and drive shaft 30 as an alternative to the packer 44 if desired.

The foregoing represent preferred embodiments of the invention. Variations and modifications will be evident to persons skilled in the art, without diverting from the inventive principles disclosed herein. All such modifications and variations are intended to be within the scope of the invention, as defined in the following claims.

The invention claimed is:

1. An electrical submersible pump assembly for use in a well comprising:

an electric motor;

a pump having an intake and an outlet;

a drive shaft configured to be driven by said motor and to drive said pump, said drive shaft having a central axis, a hollow interior, and open upper and lower shaft ends;

a liquid-gas separator assembly having a stationary tubular portion with a hollow interior communicating with the open, lower end of said drive shaft; wherein said stationary tubular portion includes a sidewall portion having openings therethrough and wherein said stationary tubular portion includes a closed, lower end; wherein said sidewall portion includes at least one outwardly extending projection shaped for urging liquid contained in a liquid/gas mixture which is flowing towards said pump intake away from said openings and cause gas contained in the liquid/gas mixture to flow through the openings into the hollow interior of said stationary tubular portion and, thereafter, to flow outwardly from said stationary tubular portion through the open lower end of the drive shaft into the drive shaft interior, wherein said at least one outwardly extending projection comprises at least one blade which wraps spirally about said sidewall portion, at least several turns, to cause liquid and gas drawn towards said pump to travel in a spiral path, wherein said openings are located on the sidewall portion between said turns such that liquid is separated from gas prior to liquid reaching the pump intake, and wherein said at least one helical blade is secured to said sidewall portion; and a bearing means for supporting said drive shaft so that said drive shaft rotates relative to said stationary tubular portion.

2. The pump assembly of claim 1, wherein said blade comprises a helical blade which extends spirally about said sidewall portion to cause liquid drawn towards said pump to travel in a helical path.

3. The pump assembly of claim 1 for use in a well casing, wherein said blade has an outer edge sized to fit tightly within the well casing, and an inner edge fitting tightly about said sidewall portion, wherein said blade and said stationary tubular portion, when installed in the well casing, form a helical channel through which gas and oil in the well must flow before reaching said pump intake.

4. The pump assembly of claim 1, wherein said blade has an inner edge fitting tightly about said sidewall portion, and wherein said liquid-gas separator assembly further comprises a hollow, cylindrical sheath surrounding the outside edge of said blade such that said blade, sheath, and sidewall portion form a helical channel through which gas and oil in the well must flow before reaching said pump intake.

5. The electrical submersible pump assembly of claim 1, further comprising stationary tubing connected to communicate with the upper end of the drive shaft which extends from said motor out of the well, so that gas and liquid exit from the well separately.

6. The pump assembly of claim 1, wherein said electric motor is located downstream of said pump and adjacent thereto, said drive shaft extends through a motor housing and a pump housing to provide a hollow passage through said housing, and said stationary tubular portion extends downwardly from said lower end of said drive shaft and has an upper end secured to said lower end of said drive shaft by said coupling means.

7. The pump assembly of claim 6, wherein said coupling means comprises bearing means.

8. An electrical submersible pump assembly for use in a well, comprising:

a pump having an intake and an outlet;

an electric motor located adjacent to said pump;

a hollow drive shaft for driving said pump and driven by said electrical motor, said drive shaft having a central axis, a hollow interior, and open upper and lower shaft ends; and a liquid-gas separator assembly having a stationary tubular portion with a hollow interior communicating with the open, lower end of said drive shaft, wherein said stationary tubular portion includes a sidewall portion having openings therethrough to allow gas in the well to flow into a hollow interior thereof, wherein said stationary tubular portion includes a closed, lower end; and wherein said sidewall portion includes at least one outwardly extending projection shaped for urging liquid contained in a liquid/gas mixture which is flowing towards said pump intake away from said openings and cause gas contained in the liquid/gas mixture to flow through the openings into the hollow interior of said stationary tubular portion, where said gas thereafter flows outwardly from said stationary tubular portion through the open lower end of the drive shaft into the drive shaft interior, wherein said at least one outwardly extending projection comprises a single blade which wraps spirally about said sidewall portion forming, at least several turns, to cause liquid and gas drawn towards said pump to travel in a spiral path, and wherein said openings are located on the sidewall between said at least several turns such that liquid is separated from gas prior to the liquid reaching the pump intake.

9. The pump assembly of claim 8, wherein said drive shaft extends through said motor housing and pump housing to provide a hollow passage through said housings.

10. The pump assembly of claim 8, wherein said blade comprises a helical blade which extends spirally about said sidewall portion to cause liquid drawn towards said pump to travel in a helical path.

11. The pump assembly of claim 8, wherein the well has a well casing, and wherein said blade has an outer edge sized to fit tightly within the well casing, and an inner edge fitting tightly about said sidewall portion, wherein said blade and said stationary tubular portion, when installed in the well casing, form a helical channel through which gas and oil in the well must flow before reaching said pump intake.

12. The pump assembly of claim 8, wherein said blade has an inner edge fitting tightly about said sidewall portion, and wherein said liquid-gas separator assembly further comprises a hollow, cylindrical sheath surrounding the outside edge of said blade such that said blade, sheath, and sidewall portion form a helical channel through which gas and oil in the well must flow before reaching said pump intake.

13. The electrical submersible pump assembly of claim 8, further comprising stationary tubing connected to communicate with the upper end of the drive shaft which extends from said motor out of the well, so that gas and liquid exit from the well separately.

* * * * *